US012110700B2

(12) United States Patent
Lee

(10) Patent No.: US 12,110,700 B2
(45) Date of Patent: Oct. 8, 2024

(54) SCAFFOLD SUPPORT

(71) Applicant: Jae Ok Lee, Seoul (KR)

(72) Inventor: Jae Ok Lee, Seoul (KR)

( * ) Notice: Subject to any disclaimer, the term of this patent is extended or adjusted under 35 U.S.C. 154(b) by 0 days.

(21) Appl. No.: 18/028,697

(22) PCT Filed: Apr. 11, 2022

(86) PCT No.: PCT/KR2022/005197
§ 371 (c)(1),
(2) Date: Mar. 27, 2023

(87) PCT Pub. No.: WO2022/239974
PCT Pub. Date: Nov. 17, 2022

(65) Prior Publication Data

US 2024/0026693 A1 Jan. 25, 2024

(30) Foreign Application Priority Data

May 11, 2021 (KR) ..... 10-2021-0060856

(51) Int. Cl.
*E04G 5/04* (2006.01)
*E04G 3/20* (2006.01)

(52) U.S. Cl.
CPC ..... *E04G 5/046* (2013.01); *E04G 3/20* (2013.01)

(58) Field of Classification Search
CPC ..... E04G 5/046; E04G 3/20
USPC ..... 248/205.1, 351, 354.1, 354.3
See application file for complete search history.

(56) References Cited

U.S. PATENT DOCUMENTS 10,094,509 B2 * 10/2018 So ..... E04G 3/34
11,091,923 B2 * 8/2021 Recker ..... E04G 21/165

FOREIGN PATENT DOCUMENTS

| | | | |
|---|---|---|---|
| JP | 11100989 | A | 4/1999 |
| JP | 2013221294 | A | 10/2013 |
| JP | 2018059351 | A | 4/2018 |
| KR | 100492719 | B1 | 6/2005 |
| KR | 101454687 | B1 | 11/2014 |
| KR | 102353898 | B1 | 1/2022 |

OTHER PUBLICATIONS

International search report of PCT/KR2022/005197, Jul. 6, 2022, English translation.

* cited by examiner

*Primary Examiner* — Todd M Epps
(74) *Attorney, Agent, or Firm* — STIP Law Group, LLC

(57) ABSTRACT

The invention relates to a scaffold support (10) comprising: a bracket (20) fixed to the wall surface (3); a screw axis member (30) having one end coupled to the bracket (20) and a male screw portion (31); an outer pipe (40) in which the other end portion of the screw axis member (30) is inserted and has a female screw portion (42) being screw-coupled to the male screw portion (31) of the screw axis member (30); a pipe rotary shaft (50) on the center of the end surface (43) of the outer pipe (40) having a polygonal head (51).

2 Claims, 5 Drawing Sheets

SCAFFOLD SUPPORT

CROSS-REFERENCE TO RELATED APPLICATIONS

This application is the U.S. National Phase under 35 U.S.C. § 371 of International Application No. PCT/KR2022/005197, filed on Apr. 11, 2022, which in turn claims the benefit of Korean Application No. 10-2021-0060856, filed on May 11, 2021, the disclosures of which are incorporated by reference into the present application.

TECHNICAL FIELD

The present invention relates to a scaffold support to fix the scaffold against the walls of the structure with a determined distance, and more particularly to a scaffold support in which the length of it can be easily adjusted according to the distance between the scaffold and the wall surface, and it can be adaptively installed according to the various constructing conditions.

BACKGROUND ART

Generally, scaffolds composed of vertical and horizontal pipes are temporarily installed in the construction site in order to construct, for example, the exterior finish work. The scaffold usually includes walk-plate on which the worker can walk and work. The scaffold can be self-supported, but it can be coupled to the wall surface of the structure for the safety if the scaffold is high-rise.

Conventionally, the scaffold is coupled to the wall surface by use of a scaffold support with a determined distance. The scaffold support comprises a fixed-lengthed body, a fixed plate provided on one end of the body and coupled to the anchor bolt embedded on the wall, and a clamp provided on the other end of the body and engaged with the pipe of the scaffold attachably or detachably.

But, in the exterior finish work, the distance between the wall and the scaffold may be changed depending on the size or shape of materials of the exterior walls, but the conventional scaffold support cannot be easily adjusted because the length of the body of the scaffold support is determined, and the fixed plate is connected integrally to the body of the scaffold support, so the body of the scaffold extends vertically against the wall. Therefore, if the pipe of the scaffold is not aligned with the scaffold support, that is, it is positioned offset on the side, the upper or the lower side of the clamp of the scaffold support, the clamp of the scaffold support cannot be clamped with the pipe of the scaffold.

DISCLOSURE

Technical Problem

The invention is proposed to solve the above-mentioned problems, and the object of the invention is to provide a scaffold support in which the length thereof can be easily adjusted according to the distance between the scaffold and the wall, and it can be adaptively installed according to the various constructing conditions such as the variation of buildings structures and the relative position between the anchor bolt and the scaffold pipe.

Technical Solution

According to an aspect of the invention, there is provided a scaffold support 10, one end of which is fixed on the wall surface 3 and the other end of which is coupled to the scaffold 1 so as to fix the scaffold 1 on the wall surface 3, wherein the scaffold 1 comprises;

- a bracket 20 fixed on the wall surface 3 by fixing means 4, 5;
- a screw axis member 30 having one end coupled to the bracket 20 and a male screw portion 31 on the outer circumferential surface thereof;
- an outer pipe 40 which has an insertion portion 41, in which the other end of the screw axis member 30 is inserted, formed in one end thereof and a closed end surface 43 at the other end thereof, and has a female screw portion 42 being screw-coupled to the male screw portion 31 of the screw axis member 30;
- a pipe rotary shaft 50 which protrudes outward from the center of the end surface 43 of the outer pipe 40, and has a polygonal head 51 at the protruding front end, wherein the polygonal head 51 is inserted in a polygonal groove 72 in a tool coupling portion 71 of an electric wrench and
- a clamp 60 having one side rotatably coupled to a clamp coupling groove 53 formed by the end surface 43 of the outer pipe 40, the pipe rotary shaft 50, and the polygonal head 51, and the other side coupled to a scaffold pipe 2 of the scaffold 1 to be attachable/detachable, wherein;
- if the electric wrench 70 is inserted on the polygonal head 51 of the pipe rotary shaft 50 and rotated, the outer pipe 50 is rotated around the pipe rotary shaft 50 and is moved along the longitudinal direction of the screw axis member 30 to be extended and contracted so that the length of the scaffold support 10 can be adjusted according to the distance between the wall surface 3 and the scaffold 1.

According to the other aspect of the invention, there is provided a scaffold support 10, wherein; the bracket 20 includes a supporting plate 21 having an insert hole 22 in which the fixing means 4, 5 fixed on the wall surface 3 are inserted, and a pair of side wall 23, 24 extending vertically from the side of the supporting plate 21, and one end of the screw axis member 30 is hinged by a hinge pin 25 crossing the side wall 23, 24 of the bracket 20.

Advantageous Effect

According to the invention, which includes a bracket 20 fixed on the wall surface 3, a screw axis member 30 having one end coupled to the bracket 20 and a male screw portion 31 on the outer circumferential surface thereof, an outer pipe 40 which has an insertion portion 41, in which the screw axis member 30 is inserted and on the inner surface of it is formed a female screw portion 42, a pipe rotary shaft 50 which protrudes outward from the center of the end surface 43 of the outer pipe 40, and has a polygonal head 51 at the protruding front end, and a clamp coupled to the pipe rotary shaft 50 and detachably clamped on the scaffold pipe 2 of the scaffold 1, as the electric wrench 70 is inserted on the polygonal head 51 of the pipe rotary shaft 50 and rotated, the outer pipe 50 is rotated around the pipe rotary shaft 50 and is moved along the longitudinal direction of the screw axis member 30 to be extended and contracted so that the length of the scaffold support 10 can be easily and rapidly adjusted according to the distance between the wall surface 3 and the scaffold 1 to achieve the high construction efficiency and saving of working time.

And, as the end of the screw axis member 30 of the scaffold support 10 is rotatably engaged in the hinge pin 25 on the bracket 20, even though the bracket 20 of the scaffold support fixed on the wall surface 3 and the scaffold pipe 2 of the scaffold 21 is not aligned to each other depending on the constructing situation, the screw axis member 30 can be rotated against the bracket 20 for the clamp 60 of the scaffold support 10 to be coupled to the scaffold, which enables the scaffold support 10 to be easily coupled to the scaffold 1 under various constructing situation in which the relative position between the pipe 2 of the scaffold 1 and the bracket 20 fixed on the wall surface 3 is offset and not aligned.

DETAILED DESCRIPTION OF THE INVENTION

Figure 1:
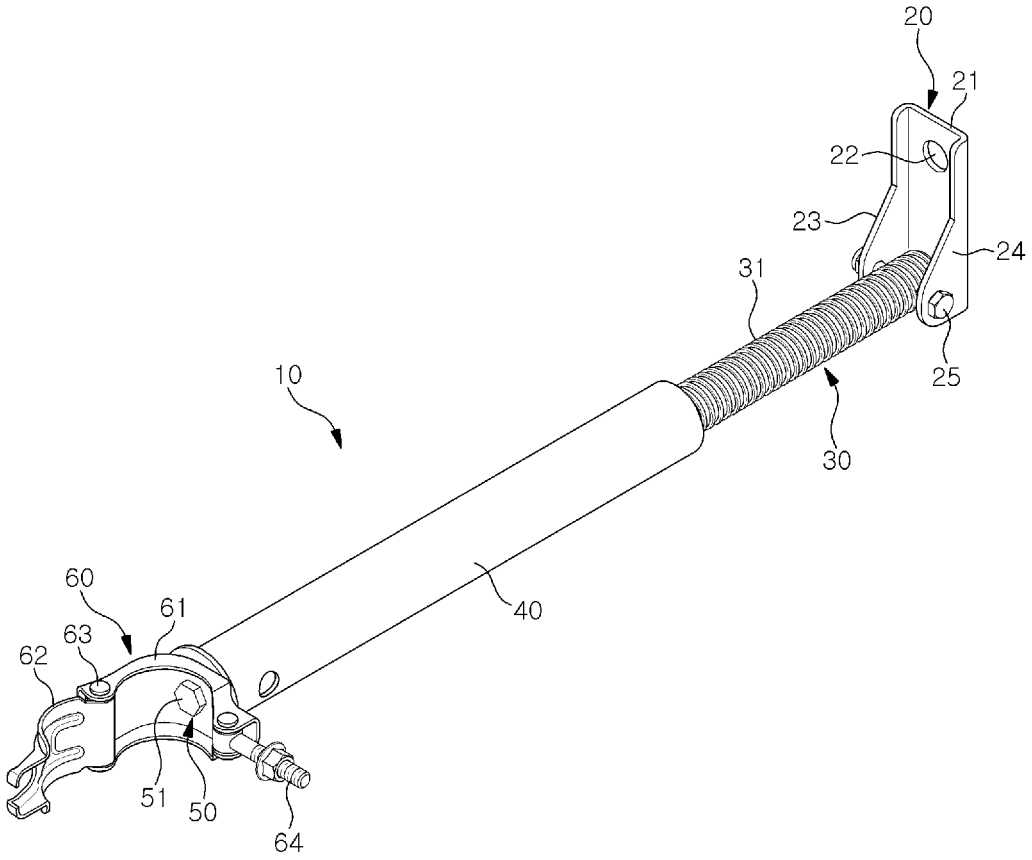
FIG. 1 is a perspective view of the preferred embodiment of the invention

Hereinafter, the preferred embodiments of the invention will be described with reference to the drawings. FIG. 1 to FIG. 5 show the preferred embodiment according to the invention. As shown in FIG, the scaffold support of the invention includes a bracket fixed on wall surface 3, a screw axis member 30, one end of which is coupled to the bracket 20, an outer pipe 40 having an insertion portion 41 on one end and being screw-coupled to the screw axis member 30, a pipe rotary shaft 50 formed in the center of the end surface 43 of the other end of the outer pipe 50, and a clamp 60 rotatably coupled to the pipe rotary shaft 50 and coupled to the scaffold pipe 2 of the scaffold 1.

The bracket 20 is fixed on the wall surface 3 by fixing means 4, 5. The fixing means 4, 5 can be an anchor bolt 3 and a nut 5 engaged with the anchor bolt 3, but other type of fixing means can be used.

Figure 3:
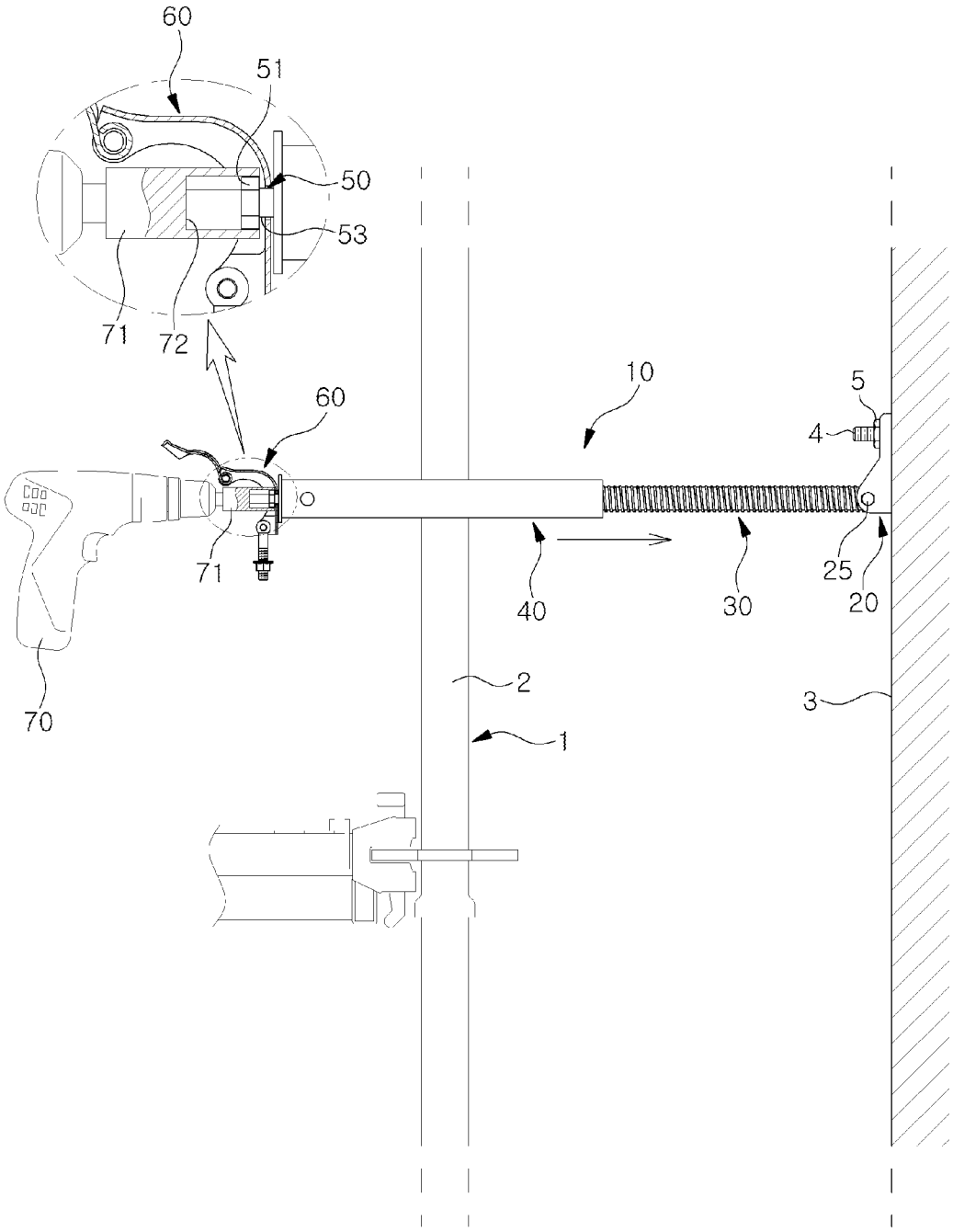
FIG. 3 is a view of extending or contracting the embodiment by using an electric wrench
Figure 4:
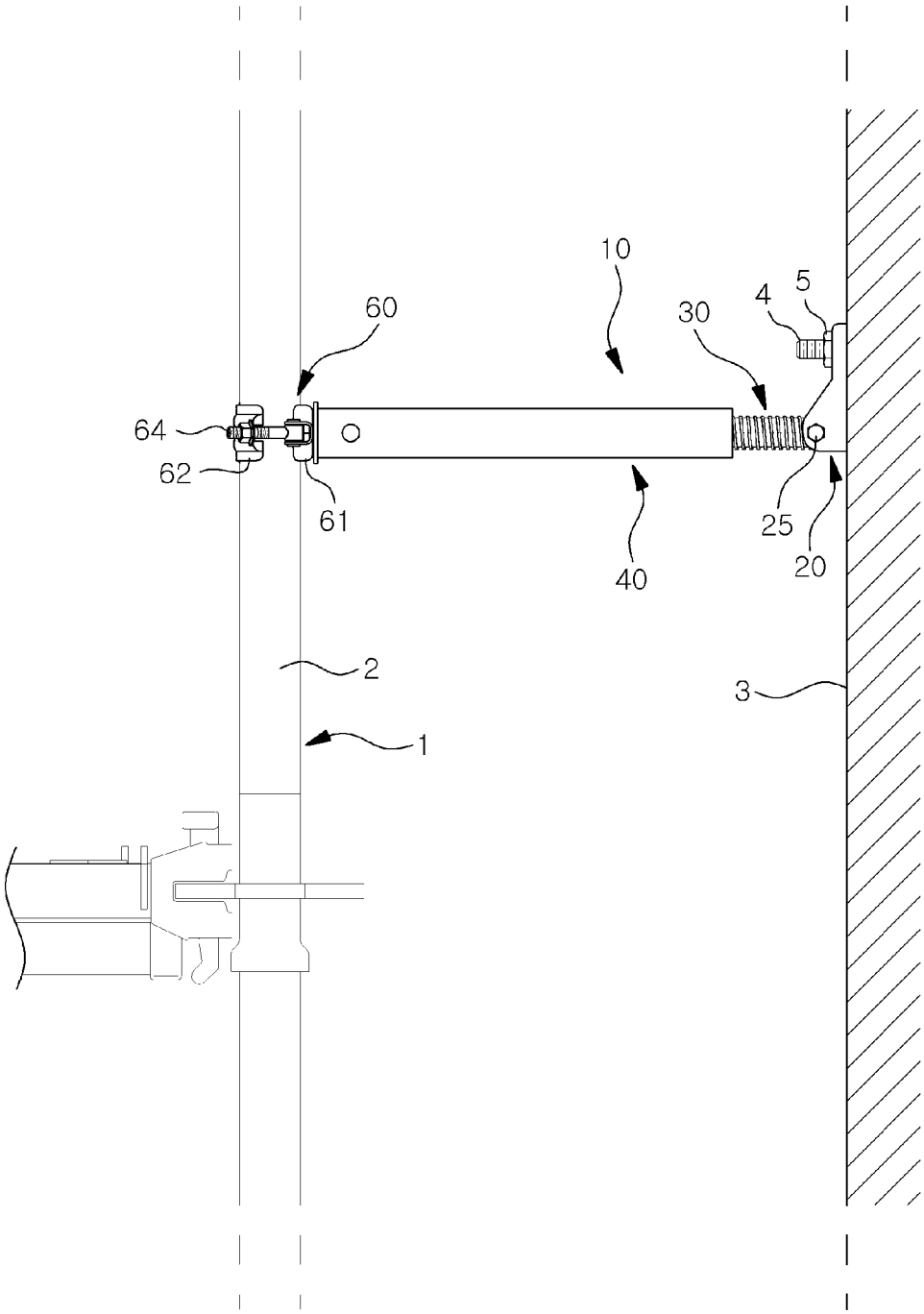
FIG. 4 is a view of the embodiment engaged on the scaffold

In the preferred embodiment of the invention, the bracket 20 includes a supporting plate 21 having an insert hole 22 in which the fixing means 4, 5 fixed on the wall surface 3 are inserted, and a pair of side wall 23, 24 extending vertically from the side of the supporting plate 21. As shown in FIGS. 1 and 3, an anchor bolt 4 is inserted into the insert hole 22 of the supporting plate 21 of the bracket 20, and a nut 6 is screwed on the anchor bolt 4 to fix the bracket 20 on the wall surface 3. Then, the supporting plate 21 can be attached on the wall surface 3 so that the side walls 23, 34 of the supporting plate 21 can be positioned horizontally, vertically or with various angles against the wall surface 3.

The screw axis member 30 has a determined length and the bracket 20 is coupled to one end of it. A male screw portion 31 is formed on the outer circumferential surface of the screw axis member 30. The screw axis member 30 can be solid or hollow.

According to the embodiment of the invention, one end of the screw axis member 30 can be hinged by the hinge pin 25 crossing the side walls 23, 24 of the bracket 20. Accordingly, the screw axis member 30 can be rotated at one end around the hinge pin 25. Then, as the side walls 23, 24 of the bracket 20 can be positioned on the side, the upper or the lower of the supporting plate 21, the hinge pin 25 can be positioned horizontally, vertically, or other various angles against the wall surface 3. Therefore, the screw axis member 30 can be rotated around the hinge pin 25, horizontally, vertically or in other angles, so that the screw axis member 30 can be rotated and coupled to the scaffold pipe 2 in various positions or dispositions.

Figure 2:
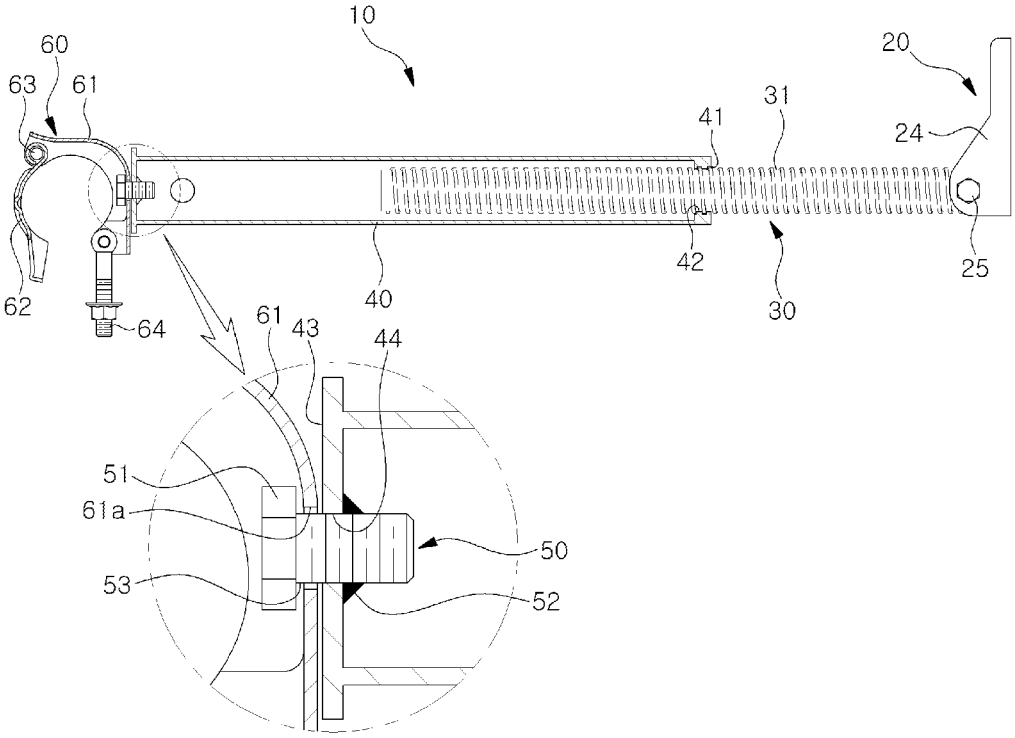
FIG. 2 is a side section of the above embodiment of the invention

The outer pipe 40 has an insertion portion 41 on one end in which the other end of the screw axis member 30 is inserted, and a female screw portion 42 on the inner surface thereof. FIG. 2 shows an embodiment in which the female screw portion 42 is formed on one end adjacent to the insertion portion 41, but it can be formed along the outer pipe 40. As the outer pipe 40 is rotated against the screw axis member 30, it moves along the longitudinal direction of the screw axis member 30 so that the scaffold support 10 can be extended or contracted. The other end of the outer pipe 40 is closed by a closed end surface 43 having a central engaging hole 44.

A pipe rotary shaft 50 protrudes outward at the center of the closed end surface 43 of the outer pipe 40 and has an enlarged polygonal head 51, such as hexagonal head at the outer end of it. It can be made of bolt with hexagonal head and inserted in the engaging hole 44 of the end surface 3 and is welded. The polygonal head 51 can be engaged with the polygonal groove 72 of the tool coupling portion 71 of the electric wrench 70. And a clamp coupling groove 53 is formed by the end surface 43 of the outer pipe 40, the shaft of the pipe rotary shaft 50, and the polygonal head 51 of the pipe rotary shaft 50.

The clamp 60 is rotatably coupled on one side with the clamp coupling groove 53 of the pipe rotary shaft 50 and is coupled on the other side with the scaffold pipe 2 of the scaffold 1. As shown in FIGS. 1 and 2, the clamp 60 includes clamp body 60 rotatably coupled to the clamp coupling groove 53 of the pipe rotary shaft 50, a clamp cover 62 hinged on the hinge pin 63 in one end of the clamp body 61 and enclosing the pipe 2 of the scaffold 1, and a fastener 64 hinged on the other side of the clamp body 61 to fasten the clamp cover 62 against the pipe 2 of the scaffold 1. A hole **61*a* is formed on the clamp body 61 through which the pipe rotary shaft 50 extends, and the polygonal head 51 of the pipe rotary shaft 50 is engaged around the hole 61*a***.

The scaffold support 10 as described above is installed, as shown in FIG. 3, by firstly inserting the anchor bolt 4 on the wall surface 3 into the insert hole 22 of the supporting plate 21 of the bracket 20, and fixing the bracket 20 on the wall surface 3 by screwing up the nut 4, then coupling the clamp 60 on the pipe 2 of the scaffold 1 spaced apart from the wall surface 3. If the distance between the wall surface 3 and the scaffold 1 is different, before the clamp 60 is coupled on the pipe 2 of the scaffold 1, the polygonal head 51 of the pipe rotary shaft 50 should be rotated by inserting the electric wrench 70 into the polygonal head 51 and rotating the electric wrench 70, then the outer pipe 40 is rotated around the pipe rotary shaft 50 and moves along the longitudinal direction of the screw axis member 30, so that the scaffold support 10 itself should extend or contract and the adjusted scaffold support 10 can be used to fix the scaffold 1 on the wall surface 3.

As described above, according to the invention, the scaffold support 10 can be easily and rapidly adjusted by using the electric wrench 70 instead of worker's manual adjusting. Therefore, the length of the scaffold support 10 can be easily and rapidly adjusted according to the distance between the wall surface 3 and the scaffold 1, which will enhance the construction efficiency and reduce the working time.

Figure 5:
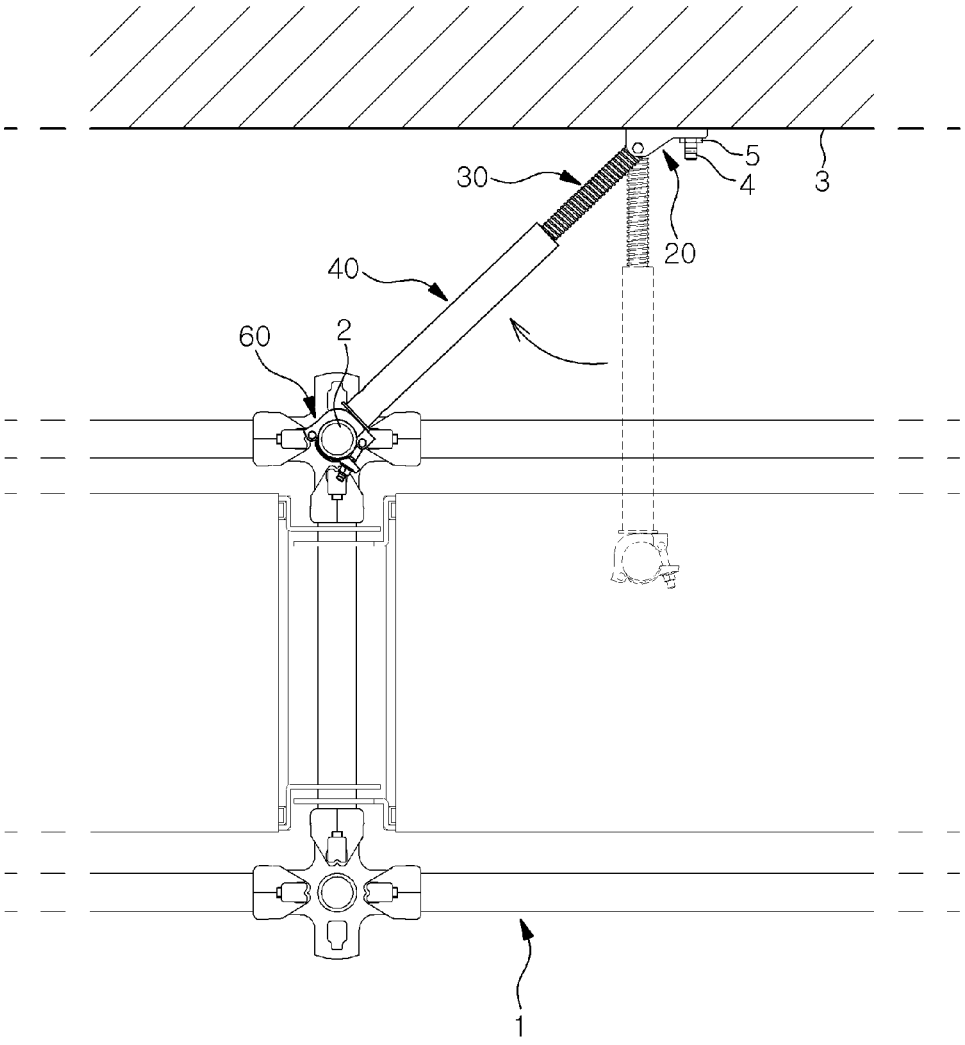
FIG. 5 is a view of the embodiment in the scaffold with a different disposition

And, as shown in FIG. 5, when the anchor bolt 4 embedded on the wall surface 3 and the pipe 2 of the scaffold 1 are offset and not aligned horizontally or vertically, then the screw axis member 30 of the scaffold support 10 can be rotated around the hinge pin 25 of the bracket 20 so that the clamp 60 can be coupled to the pipe 2 of the scaffold 1, therefore, the scaffold 1 can be easily fixed on the wall surface 3 in various construction conditions.

The invention claimed is:

1. A scaffold support (10), one end of which is fixed on a wall surface (3) and the other end of which is coupled to a scaffold (1) so as to fix the scaffold (1) on the wall surface (3), wherein the scaffold support (10) comprises;

a bracket (20) fixed on the wall surface (3) by fixing means (4, 5);

a screw axis member (30) having one end coupled to the bracket (20) and a male screw portion (31) on an outer circumferential surface thereof;

an outer pipe (40) which has an insertion portion (41), in which the other end of the screw axis member (30) is inserted, formed in one end thereof and a closed end surface (43) at the other end thereof, and has a female screw portion (42) being screw-coupled to the male screw portion (31) of the screw axis member (30);

a pipe rotary shaft (50) which protrudes outward from a center of the end surface (43) of the outer pipe (40), and has a polygonal head (51) at a protruding front end, wherein the polygonal head (51) is inserted in a polygonal groove (72) in a tool coupling portion (71) of an electric wrench (70); and a clamp (60) having one side rotatably coupled to a clamp coupling groove (53) formed by the end surface (43) of the outer pipe (40), the pipe rotary shaft (50), and the polygonal head (51), and the other side coupled to a scaffold pipe (2) of the scaffold (1) to be attachable/detachable, wherein;

if the electric wrench (70) is inserted on the polygonal head (51) of the pipe rotary shaft (50) and rotated, the outer pipe (40) is rotated around the pipe rotary shaft (50) and is moved along a longitudinal direction of the screw axis member (30) to be extended and contracted so that a length of the scaffold support (10) can be adjusted according to a distance between the wall surface (3) and the scaffold (1).

2. A scaffold support of claim 1, wherein; the bracket (20) includes a supporting plate (21) having an insert hole (22) in which the fixing means (4, 5) fixed on the wall surface (3) are inserted, and a pair of side wall (23, 24) extending vertically from the side of the supporting plate (21), and one end of the screw axis member (30) is hinged by a hinge pin (25) crossing the side wall (23, 24) of the bracket (20).

* * * * *